US008104191B2

(12) United States Patent
Ricklefs et al.

(10) Patent No.: US 8,104,191 B2
(45) Date of Patent: Jan. 31, 2012

(54) LAUNDRY DRYER PROVIDING MOISTURE APPLICATION DURING TUMBLING AND REDUCED AIRFLOW

(75) Inventors: Michael Paul Ricklefs, Webster City, IA (US); Brian Douglas Ripley, Webster City, IA (US)

(73) Assignee: Electrolux Home Products, Inc., Cleveland, OH (US)

( * ) Notice: Subject to any disclaimer, the term of this patent is extended or adjusted under 35 U.S.C. 154(b) by 853 days.

(21) Appl. No.: 12/184,013

(22) Filed: Jul. 31, 2008

(65) Prior Publication Data

US 2010/0024243 A1 Feb. 4, 2010

(51) Int. Cl.
*F26B 21/08* (2006.01)

(52) U.S. Cl. ..... 34/474; 34/86; 34/601; 34/72; 68/5 R; 68/17 R; 8/149.3

(58) Field of Classification Search ..... 34/474, 34/86, 601, 602, 606, 610, 77, 80, 8, 6; 68/5 R, 68/17 R; 8/149.3
See application file for complete search history.

(56) References Cited

U.S. PATENT DOCUMENTS

| | | | |
|---|---|---|---|
| 2,247,817 | A | 7/1941 | McMahan |
| 2,643,463 | A | 6/1953 | Grantham |
| 2,812,593 | A | 11/1957 | Olthuis |
| 2,961,776 | A | 11/1960 | Hughes |
| 3,033,546 | A | 5/1962 | Rosenberg |
| 3,034,221 | A | 5/1962 | Tuck et al. |
| 3,242,584 | A | 3/1966 | Jacobs |
| 3,264,750 | A | 8/1966 | Berenbaum |
| 3,309,783 | A | 3/1967 | Worst |
| 3,309,784 | A | 3/1967 | Worst |
| 3,364,588 | A | 1/1968 | Ziegler |
| 3,402,576 | A | 9/1968 | Krupsky |
| 3,447,248 | A | 6/1969 | Triplett et al. |
| 3,483,632 | A | 12/1969 | Triplett |
| 3,513,566 | A | 5/1970 | Shacklock et al. |
| 3,514,867 | A | 6/1970 | Patrick |
| 3,597,851 | A | 8/1971 | Arendt et al. |
| 3,670,425 | A | 6/1972 | Benjamin et al. |
| 3,672,188 | A | 6/1972 | Geschka et al. |

(Continued)

FOREIGN PATENT DOCUMENTS

DE 10332656 7/2004

(Continued)

*Primary Examiner* — Stephen M. Gravini
(74) *Attorney, Agent, or Firm* — Banner & Witcoff, Ltd

(57) ABSTRACT

A laundry dryer includes a rotatable drum, an air delivery system selectively operable to provide air into the drum at a first flow rate and a second flow rate that is less than the first flow rate, and a moisture delivery system operable to provide moisture (e.g., water mist or steam) into the drum while air is being provided at the lower second flow rate, and during drum rotation (tumbling), to thus enhance dispersion of the moisture into the fabrics of the load, and the attendant dewrinkling/refresh benefits. The air delivery system can include a reversible blower that provides air at the first flow rate when operated in a first direction and provides air at the second flow rate when operated in an opposite second direction. The drum can be a reversibly rotatable drum that is rotatable in a first and an opposite second direction, and the dryer can include a drive motor that both rotates the drum and operates the blower. The moisture delivery system can include a nozzle to provide moisture directly into the drum.

33 Claims, 15 Drawing Sheets

U.S. PATENT DOCUMENTS

| | | | | |
|---|---|---|---|---|
| 3,831,292 | A * | 8/1974 | DePas | 34/75 |
| 4,137,029 | A * | 1/1979 | Brooks | 425/222 |
| 4,193,208 | A * | 3/1980 | Ronning | 34/131 |
| 4,207,683 | A | 6/1980 | Horton | |
| 4,338,730 | A | 7/1982 | Tatsumi et al. | |
| 4,489,507 | A * | 12/1984 | Kawai | 34/77 |
| 4,498,317 | A | 2/1985 | Thysen et al. | |
| 4,519,145 | A | 5/1985 | Mandel | |
| 4,586,267 | A | 5/1986 | Sussman | |
| 4,622,759 | A | 11/1986 | Abe et al. | |
| 4,713,894 | A | 12/1987 | Roth et al. | |
| 4,984,317 | A | 1/1991 | Christ | |
| 5,029,458 | A | 7/1991 | Obata et al. | |
| 5,388,348 | A | 2/1995 | Tanaka et al. | |
| 5,537,761 | A | 7/1996 | Oh | |
| 5,555,645 | A | 9/1996 | Joslin | |
| 5,564,831 | A | 10/1996 | Bashark | |
| 5,651,194 | A | 7/1997 | Hayashi | |
| 5,730,006 | A | 3/1998 | Conley | |
| 5,768,730 | A | 6/1998 | Matsumoto et al. | |
| 6,006,445 | A | 12/1999 | Large | |
| 6,032,494 | A | 3/2000 | Tanigawa et al. | |
| 6,154,978 | A | 12/2000 | Slutsky | |
| 6,334,267 | B1 | 1/2002 | Slutsky | |
| 6,405,453 | B1 | 6/2002 | Salameh et al. | |
| 6,585,781 | B1 | 7/2003 | Roseen | |
| 6,691,536 | B2 | 2/2004 | Severns et al. | |
| 6,796,055 | B2 | 9/2004 | Baltes | |
| 7,017,280 | B2 | 3/2006 | Green et al. | |
| 7,021,087 | B2 | 4/2006 | France et al. | |
| 7,055,262 | B2 * | 6/2006 | Goldberg et al. | 34/86 |
| 7,162,812 | B2 | 1/2007 | Cimetta et al. | |
| 7,325,330 | B2 | 2/2008 | Kim et al. | |
| 2004/0154194 | A1 | 8/2004 | Prows | |
| 2004/0194339 | A1 | 10/2004 | Johnson et al. | |
| 2005/0115120 | A1 | 6/2005 | Cevik | |
| 2005/0252250 | A1 | 11/2005 | Oh et al. | |
| 2006/0005581 | A1 | 1/2006 | Banba | |
| 2006/0179678 | A1 | 8/2006 | Jonsson et al. | |
| 2006/0191077 | A1 | 8/2006 | Oh et al. | |
| 2007/0006484 | A1 | 1/2007 | Moschuetz et al. | |
| 2007/0256321 | A1 | 11/2007 | Bae et al. | |
| 2008/0134446 | A1 | 6/2008 | Park et al. | |
| 2008/0141550 | A1 | 6/2008 | Bae et al. | |
| 2008/0141552 | A1 | 6/2008 | Bae et al. | |
| 2008/0141553 | A1 | 6/2008 | Son et al. | |
| 2008/0141554 | A1 | 6/2008 | Bae et al. | |
| 2008/0141557 | A1 | 6/2008 | Son et al. | |
| 2008/0141558 | A1 | 6/2008 | Bae et al. | |
| 2008/0141734 | A1 | 6/2008 | Son et al. | |
| 2008/0148493 | A1 | 6/2008 | Hong et al. | |
| 2009/0071032 | A1 | 3/2009 | Kreutzfeldt et al. | |
| 2010/0024243 | A1 * | 2/2010 | Ricklefs et al. | 34/474 |

FOREIGN PATENT DOCUMENTS

| | | | |
|---|---|---|---|
| EP | 0080268 | | 6/1983 |
| EP | 0424781 | | 5/1991 |
| EP | 1275767 | | 1/2003 |
| EP | 1441060 | | 11/2003 |
| EP | 1 441 060 | | 7/2004 |
| EP | 1936022 | A1 * | 6/2008 |
| GB | 2051330 | | 1/1981 |
| GB | 2151861 | | 7/1985 |
| JP | 02258000 | | 10/1990 |
| JP | 5277294 | | 10/1993 |
| JP | 2005261691 | A * | 9/2005 |
| WO | 2008/141750 | | 11/2008 |

* cited by examiner

LAUNDRY DRYER PROVIDING MOISTURE APPLICATION DURING TUMBLING AND REDUCED AIRFLOW

FIELD OF THE INVENTION

The present invention relates to laundry dryers. In particular, the invention concerns laundry driers having a system for introducing moisture during a reduced airflow portion of its operations to provide advantages such as de-wrinkling or refreshing items in the laundry load.

BACKGROUND OF THE INVENTION

Conventional laundry dryers include a rotatable drum in which fabrics are tumbled during the drying process. Some dryers include the capability to introduce steam into the drum to reduce wrinkles in the fabrics. However, these prior art systems are unable to optimally retain steam in the drum while maintaining optimal drum rotation, which reduces the steam's usefulness. Such laundry dryers include condenser clothes dryers and vented clothes dryers.

Condenser clothes dryers circulate air exhausted from the drum through a heat exchanger/condenser to cool the air and condense its moisture. They subsequently recirculate it back through the drum. The recirculated air retains a portion of its moisture when reintroduced into the drum after traveling through the condenser. The level of moisture content can be increased via the addition of atomized water to the recirculated air prior to reintroducing it to the drum. See, e.g., U.S. Pat. No. 7,162,812.

Vented clothes dryers draw air from the surrounding area, heat it, blow it into the drum during operation, and then exhaust it through a vent to the outside. Some vented dryers introduce steam into the drum for reducing wrinkles in the clothes, but are unable to retain steam in the drum for optimal de-wrinkling or refreshing benefits. Further, some vented dryers introduce steam into the drum while intermittently rotating the drum, which may provide sub-optimal tumbling during steam exposure and can limit steam dispersion into the clothes.

Some vented dryers have separate motors for rotating the drum and for driving the air circulation blower. This permits the drum rotation speed to be set independently of the blower, but these systems suffer drawbacks related to the use of two motors instead of a single motor, such as increased costs and control complexities. Conventional single motor systems typically have fixed speed on-off operation. A motor provided with a variable speed control would present the opportunity to periodically slow the blower speed along with the drum rotation speed, or the motor could be turned off for short periods to stop the blower while the drum rotates via its momentum. See, e.g., U.S. Pat. No. 7,325,330. However, these systems may provide sub-optimal tumbling during steam exposure due to intermittent or slower drum rotation speeds, which can limit steam dispersion into the clothes. In addition, variable speed motor control adds complexity and cost.

Reversing dryers, i.e., dryers that reverse the rotation direction of the drum, are also known. In some instances, such reversal has been provided with a single motor that drives both the blower and the drum, and with the blower creating a lower airflow rate when driven in the reverse direction. See, e.g., Joslin U.S. Pat. No. 5,555,645 and Hughes U.S. Pat. No. 2,961,776.

SUMMARY OF THE INVENTION

A laundry dryer that selectively applies moisture to fabrics during operations can include a rotatable drum, an air delivery system operable to selectively provide air into the rotating drum at a first flow rate and at a second flow rate that is less than the first flow rate, and a moisture delivery system operable to provide moisture into the drum while air is being provided at the lower second flow rate. Moisture can be retained within the drum longer and, thus, can potentially more effectively remove wrinkles from, and refresh/deodorize, fabrics. The moisture ($H_2O$) can be provided in various forms, such as steam, sprayed droplets, a mist, drips, or combinations thereof.

The air delivery system can include a reversible blower that provides air at the first flow rate when operated in a first direction and provides air at the second flow rate when operated in an opposite second direction. The drum can be a reversibly rotatable drum that is rotatable in a first direction and an opposite second direction, and the dryer can include a drive motor that both rotates the drum and operates the blower. The drive motor can rotate the drum in its first rotational direction and simultaneously rotate the blower in its corresponding first operational direction during portions of its operations, as well as rotate the drum and simultaneously operate the blower in their second directions during other portions of its operations.

The moisture delivery system can include a nozzle to provide moisture directly into the drum. The moisture can be ejected from the nozzle in liquid or gaseous form, or in combinations thereof. The moisture can be provided from a fluid that primarily includes water, which can be received from an external water source. The water can be ambient water that is not actively heated via a heater. That water can be, but is not necessarily, changed into steam when provided into the warm environment of the drum, such as being sprayed as a mist or dripped as droplets. Alternatively, the water may be supplied into the drum in the form of steam from water heated in a steam generation unit.

The above and other objects, features and advantages of the present invention will be readily apparent and fully understood from the following detailed description of preferred embodiments, taken in connection with the appended drawings.

DETAILED DESCRIPTION

Figure 1:
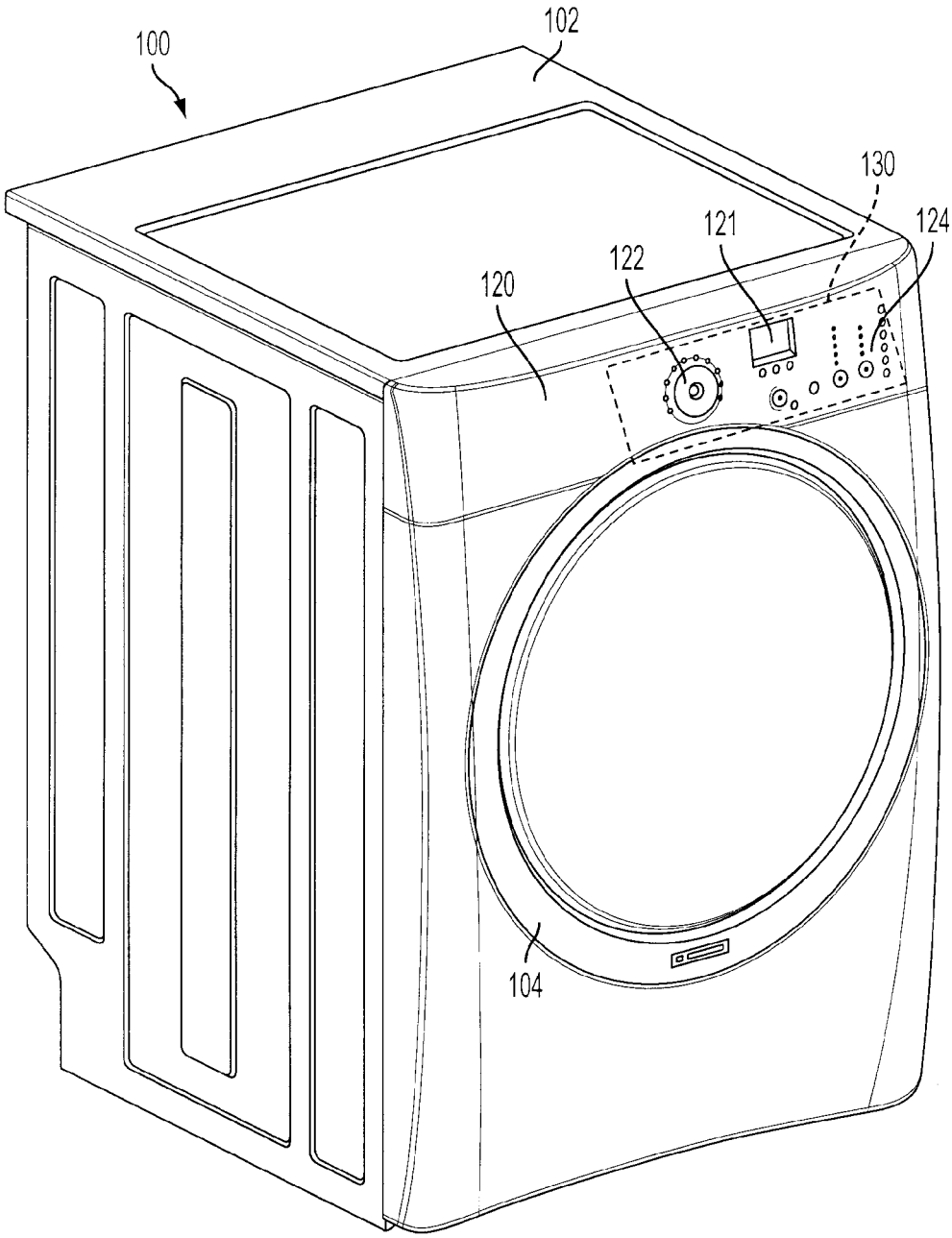
FIG. 1 is a front perspective view of a dryer that incorporates features in accordance with the present invention.
Figure 2:
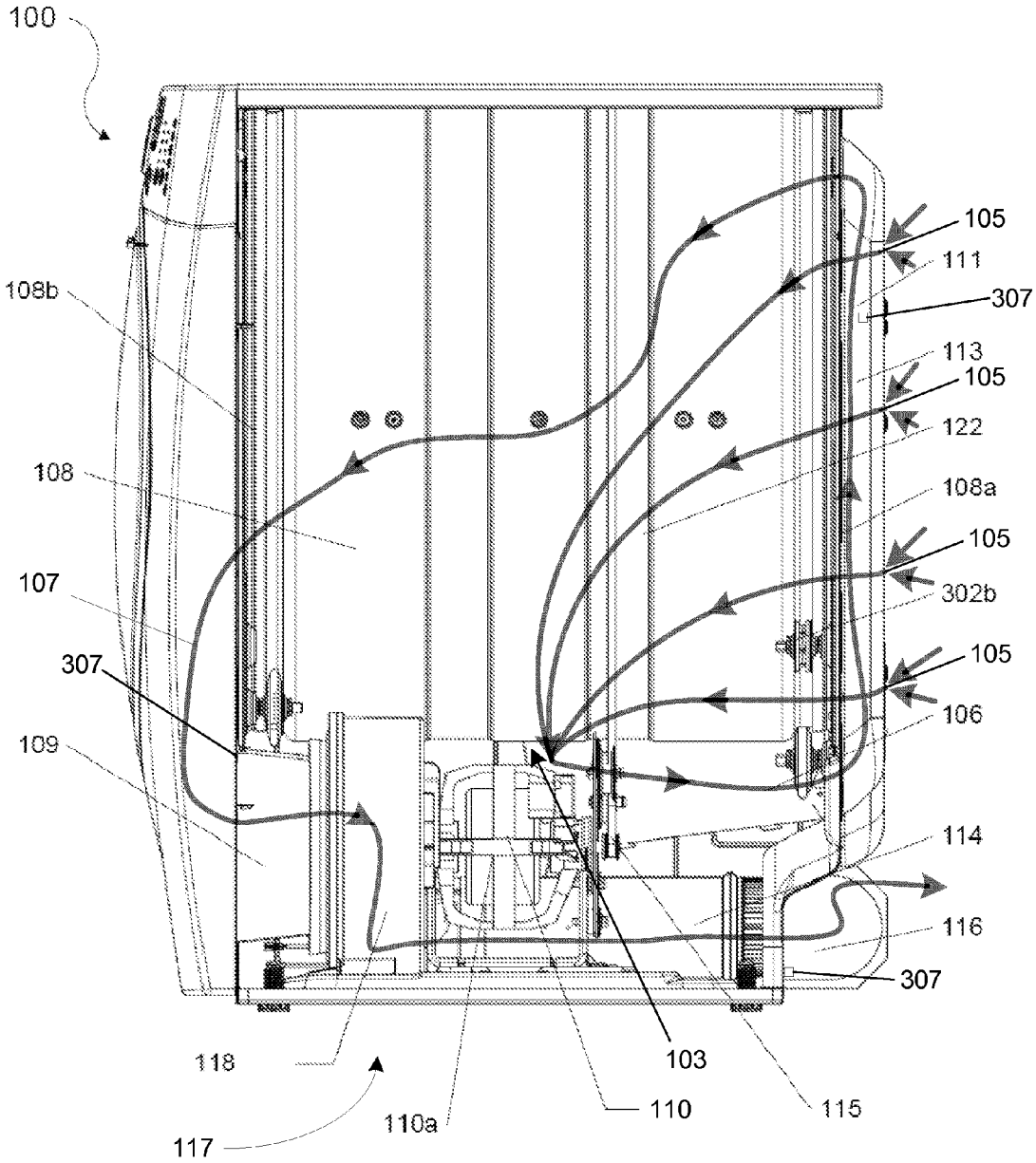
FIG. 2 is a right side elevation view of the illustrative dryer of FIG. 1 with the side panel removed to show internal components.
Figure 3:
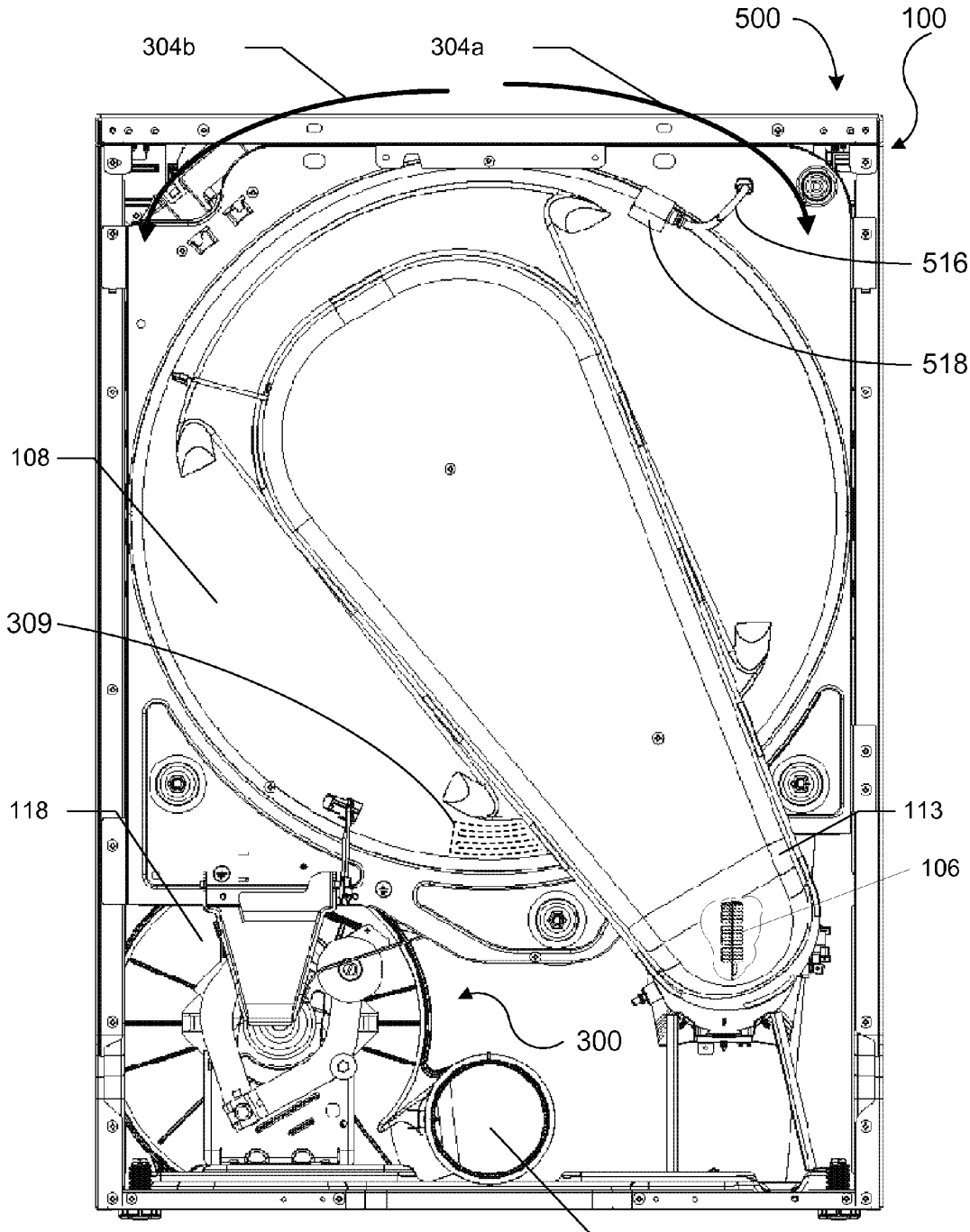
FIG. 3 is a rear elevation view of the illustrative dryer of FIG. 1 with the rear panel removed to show internal components.

An example configuration of a laundry dryer 100 in accordance with features of the present invention is shown in FIGS. 1-3. Although described in the context of dryer 100, features described herein, such as moisture application features, drum reversal features and/or air flow control features, can be used with various types and configurations of laundry dryers, such as a gas powered laundry dryer, electric powered laundry dryer, stackable laundry dryer, free standing front loading laundry dryer, and the like. Dryer 100 generally includes many conventional features of known dryer systems. In addition, dryer 100 includes a control system 130, an air delivery system 117, a drive system 110, and a moisture delivery system 510 that advantageously cooperate to provide moisture to fabrics being rotated within dryer drum 108 during operations.

As shown in FIG. 1, the dryer 100 includes a housing 102. Housing 102 generally includes a door 104 covering an access port. The dryer can also include a pedestal (not shown) that is provided to lift the dryer to a raised position for easier access to the access port. The pedestal can include a drawer or cabinet that can be used for storage of laundry related items, such as detergent, fabric softener, and the like. Housing 102 generally contains electrical and mechanical systems for typical dryer function.

With further reference to FIG. 1, dryer 100 has a control system 130 that generally includes a control panel 120 and an electronic control system 132. Control panel 120 generally includes one or more buttons, knobs, indicators, and the like, that are used to control the dryer operation. In the arrangement shown, a knob 122 and one or more buttons 124 are used in conjunction with a user interface display 121 for establishing the dryer settings. The electronic control system 132 includes a processor, memory, relays and the like (not shown), as is generally known in the art, which provide dryer cycle selections to the user and control operation of the dryer.

Figure 9:
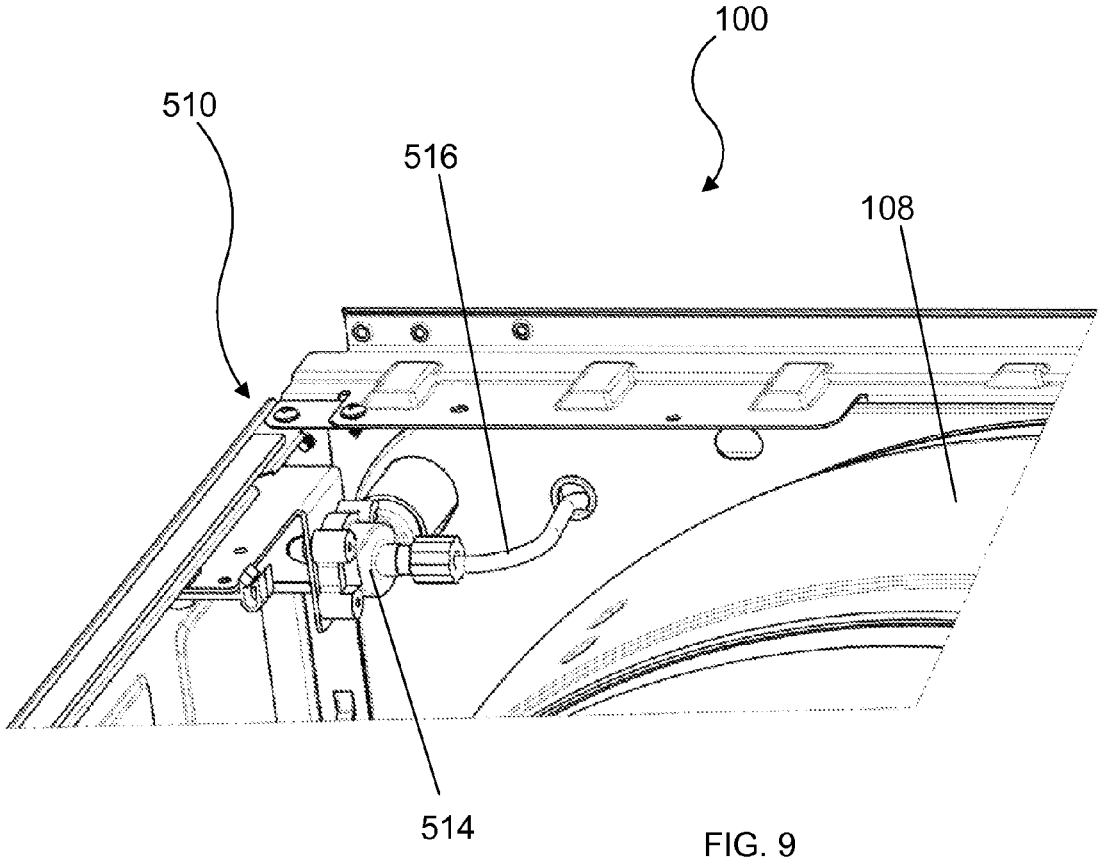
FIG. 9 is a close perspective view of portions of the mist delivery system of FIG. 7.

With reference to FIG. 2, the electronic control system 132 communicates with dryer components, such as temperature sensors 307, moisture sensor 309, and moisture control valve 512 (FIG. 9), to receive inputs and/or provide instructions for controlling dryer operation. Temperature sensors 307 can include one or more thermostats, thermistors, or other temperature measurement devices used in one or more locations in dryer 100, such as in an inlet and/or exhaust of the dryer. Moisture sensor 309 can include, as illustrated, conductive strips, i.e., or moisture sensor bars, mounted within the drum on or proximate a lower portion of the rear bulk-head. The bars form an open circuit that is closed via contact with wet or damp fabrics, as is generally known in the art. Control system 132 can ascertain the dryness level of the fabrics based upon changes in resistance across the strips caused by contact with the fabrics of the load. Other types of moisture sensing techniques could also be used, such as temperature sensors that measure the exhaust air temperature to estimate the dryness of the clothes.

Referring to FIGS. 2 and 3, dryer 100 includes an air delivery system 117. The air delivery system generally includes a blower 118, a heater 106, such as a canister-type heater, and pathways for directing air along an air path 107. Air enters the cabinet 103 of the dryer system via intake vents 105 disposed along housing 102. The air travels along air path 107 from intake vents 105 into cabinet 103 and is drawn through heater 106 from within the cabinet. Heater 106 heats air as it passes through the dryer system and, as shown in FIG. 2, can be positioned below a rotatable drum 108 in which fabrics are contained and tumbled during dryer operations. The heated air is introduced to the rotatable drum 108 through an inlet duct 111 extending along a back side of and passing through a rear bulkhead 113 at a rear side of the drum. The air exits the drum 108 from a front side of the drum through a duct 109 including a lint trap (not shown) into blower 118, from which it travels through exhaust tube 114 and is exhausted outside the dryer via an exhaust vent 116. Air path 107 can include passive valves, such as check valves (not shown) disposed at exhaust vent 116 and/or along the air path. Air path 107 can also exclude active valves, such as electronically controlled mechanical or electrical valves (e.g., solenoid valves) and, thus, provide a relatively simple and efficient air delivery system without active valves that is easily controlled via operation of blower 118.

The dryer further includes a drive system 110 configured to rotate rotatable drum 108. The drive system 110 includes a motor **110*a* that rotates drum 108 via a belt 122 and a drive pulley 115. In the arrangement shown, the motor is also part of air delivery system 117 and drives blower 118, which creates a vacuum to pull air through the dryer system. Blower 118 is connected to an exhaust tube 114 that connects with an external vent tube 116** for exhausting air from the dryer.

As mentioned, the rotatable drum can be rotated using a belt drive system. As seen in FIG. 2, belt 122 wraps about the circumference of drum 108 and is driven by motor **110*a*** to cause the rotatable drum to rotate about a central axis. Existing dryers employing a bulkhead mount of the rotatable drum, in lieu of a center axle mount, typically only provide for drum rotation in a single direction. The illustrated dryer employs such a bulkhead mount of the drum, and also is configured to provide bi-directional drum rotation.

As shown in FIG. 3, rotatable drum 108 can reverse direction during dryer operations. For example, drum 108 can cease rotating in the clockwise direction of arrow **304*a* and begin rotating in the opposite direction as indicated by arrow 304*b*. This bi-directional rotation can aid in tumbling of a dryer load in a manner that reduces tangling and balling of the load items. This can provide more efficient and faster drying of the load within the drum 108, and facilitate unloading once the drying operations are complete. In addition, in the case of a single motor used to both drive the drum rotation and the blower, the differential flow characteristics achieved by driving the blower in different directions can be used with advantage and convenience in conjunction with reversal of the drum rotation direction. For example, a finish-dry or cool-down interval could be implemented utilizing a reverse drum rotation and accompanying reduced (or increased) airflow caused by a reversal of the blower wheel. Further, as discussed below along with FIGS. 8-12**, moisture can be introduced into the drum while it operates in reverse and produces reduced airflow, which can permit extended exposure to moisture (e.g., water vapor, steam or a mixture thereof) to the fabrics in the load during more optimal, continuous tumbling of the fabrics.

Figure 4:
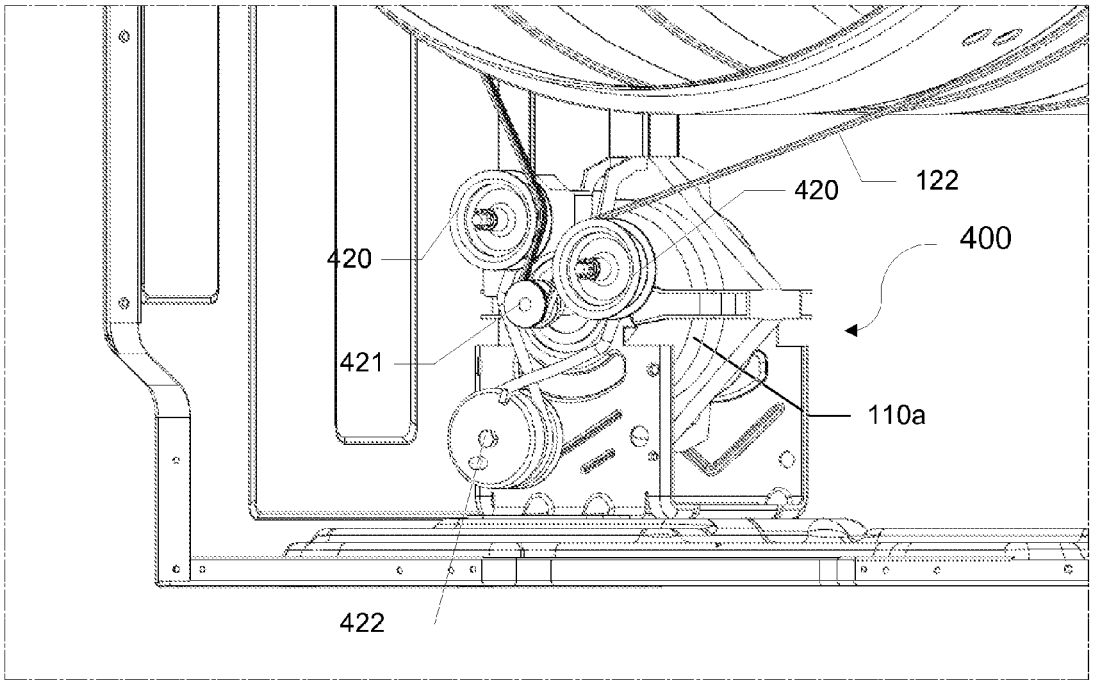
FIG. 4 illustrates the reversing idler assembly of FIG. 3 as it can be mounted in a dryer for use.

With reference now to FIG. 4, a reversing idler spring assembly 400 is shown that can assist with selectively driving the drum in opposite directions. Reversing idler spring assembly 400 is of a type disclosed in commonly owned U.S. patent application Ser. No. 11/960,237 filed on Dec. 19, 2007, which is hereby incorporated by reference in its entirety. This application also discloses an advantageous bi-directional rotatable drum mounting arrangement that may be used in conjunction with the moisture application features described herein.

In general, idler assemblies are known for maintaining appropriate tension on the drive belt extending about the dryer drum and the drive pulley. One such idler 300 is shown in FIG. 3. It will be understood that other reversible idler assembly configurations could be used along with dryer 100. In the configuration shown in FIG. 4, reversing idler assembly 400 includes two tensioning pulleys 420 biased by a common spring member also serving as a mounting bracket for the pulleys. Reversing idler assembly 400 aids in equalizing the drive belt forces regardless of the direction of rotation of the dryer drum.

Reversing idler assembly 400 is shown in FIG. 4 mounted on a bracket extending up from a floor of the dryer housing with dryer drive belt 122 installed thereon. As shown, the assembly 400 is mounted (at pivot point 422) below motor 110*a* along with the drive shaft 423 and belt drive pulley 421 thereof which drives belt 122. The arms cross each other below the drive shaft and then extend upwardly on either side of the drive shaft so as to position the pulleys 420 just above, and in alignment with, the drive pulley, so as to form therewith a generally triangular arrangement. Belt 122 extends in a loop about the dryer drum. The loop is passed between the two pulleys 420 and about the drive pulley. Reversing idler assembly 400 maintains appropriate tension on the belt 452 so that it can be driven by the drive pulley in order to rotate the rotatable drum without slippage, regardless of the rotation direction. As rotation of the drum reverses, the idler assembly 400 can pivot about spring pivot center 422 thereby causing the tension to be distributed to an opposite side of the belt again to allow the belt 122 to be driven by the drive pulley in order to rotate the drum without slippage.

Figure 5A:
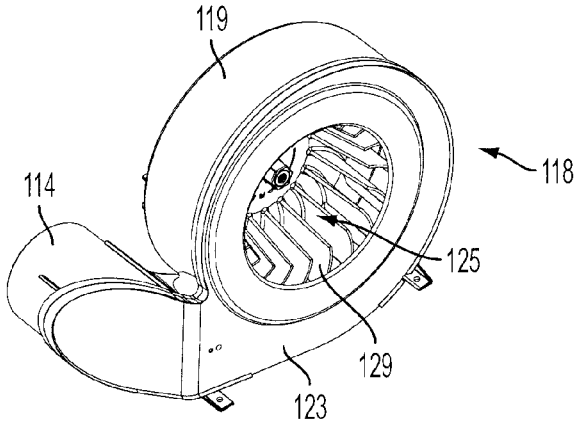
FIGS. 5A-5C are perspective, exploded and side views of a blower assembly described herein.
Figure 5B:
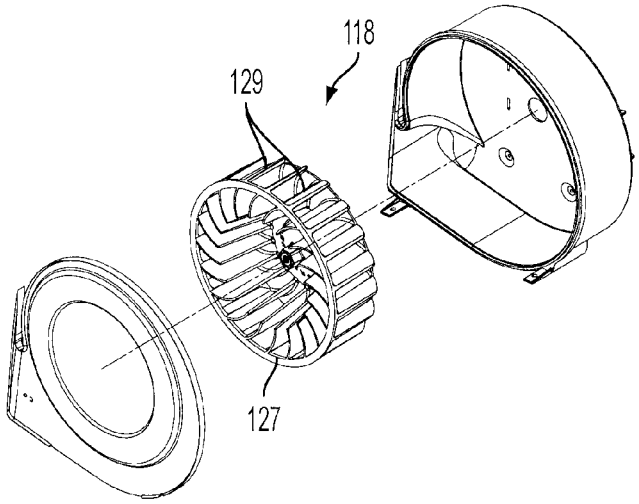
Figure 5C:
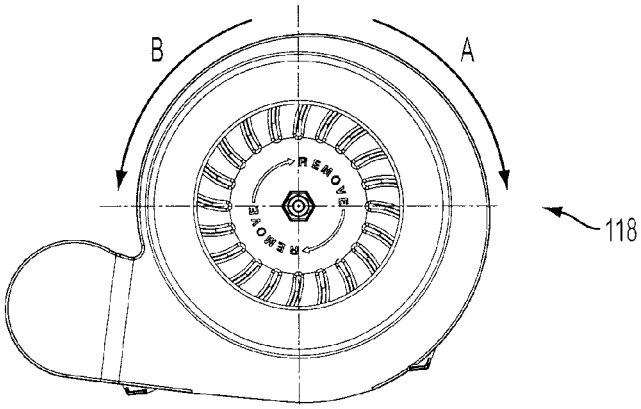

Referring now to FIGS. 5A-5C, blower assembly 118 is shown along with a portion of exhaust tube 114. As discussed previously, the blower can be driven by motor 110*a*, which also operates to rotate drum 108, but the blower could also be independently driven via a second motor (not shown) in an alternative configuration. Blower assembly 118 can be driven by motor 110*a* via a drive connection (not shown), such as a direct drive connection, a clutch connection, or a belt drive connection. In the configuration shown, blower assembly 118 includes a housing 119, a cover 123 having an inlet 125, and a rotatable blower wheel or impeller 127 having curved blades 129 thereon.

During operation, blades 129 draw in air axially through inlet 125 along the impeller's axis of rotation and discharge air radially outwardly into exhaust tube 114. The air drawn into inlet 125 can be from drum 108 via duct 109 at the front of the dryer. The airflow direction remains the same when the impeller is rotated in direction A (FIG. 5C) or in opposite direction B. However, the blower operates more effectively when rotated in direction A than in direction B due to the concave curvature of its blades directed toward direction A. Thus, the airflow is much higher when the blower rotates in direction A at a certain speed than when rotated in opposite direction B at the same speed.

Figure 6:
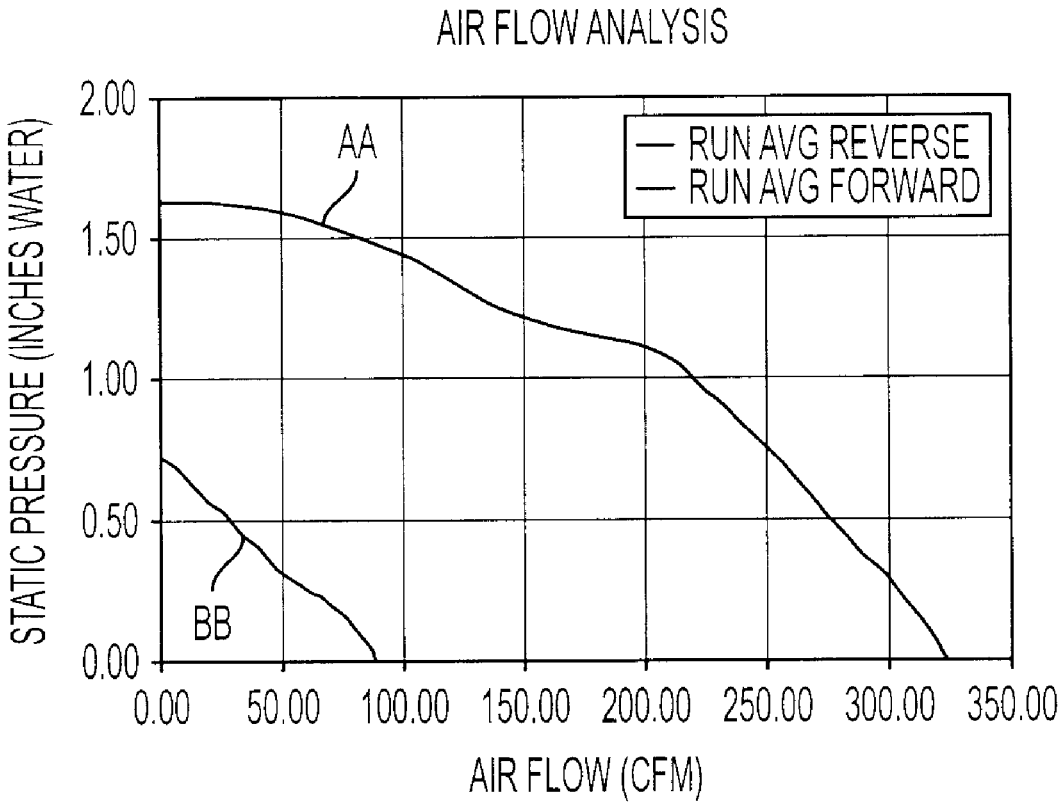
FIG. 6 is a chart illustrating airflow versus pressure for the blower assembly of FIG. 5 when operated in forward and reverse directions.
Figure 7:
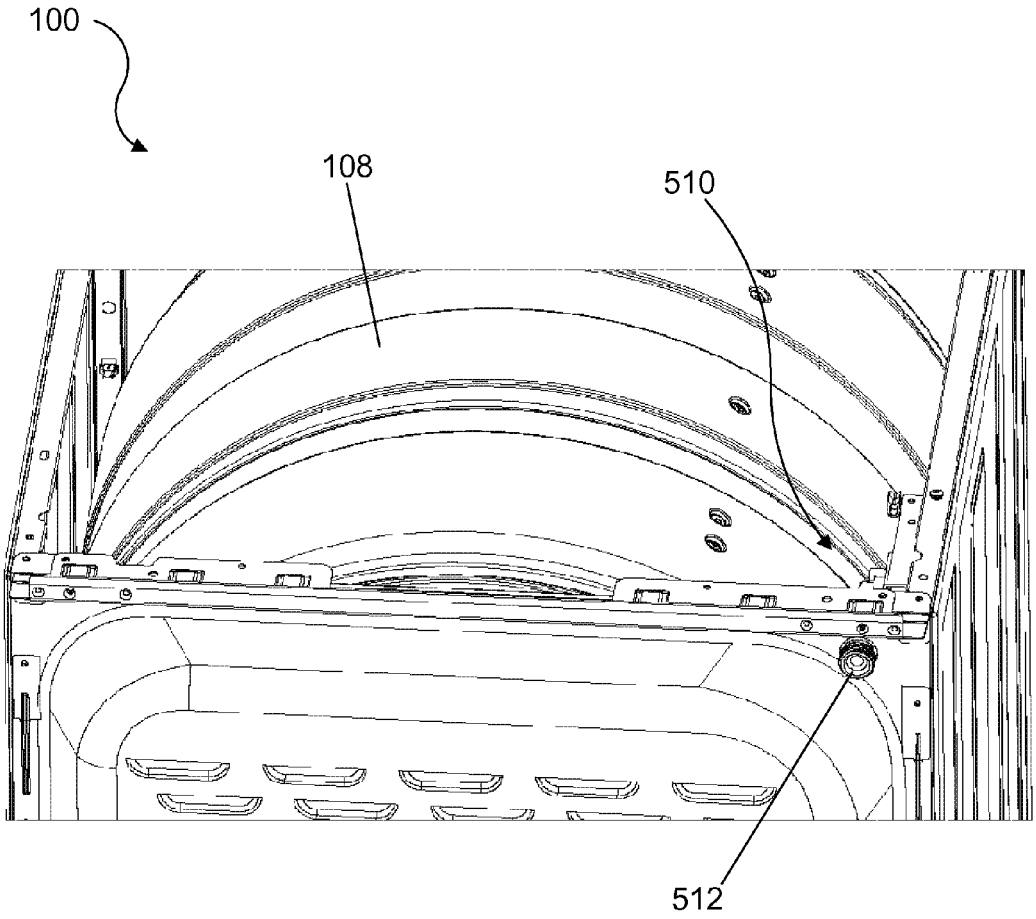
FIG. 7 is a rear perspective view of the dryer of FIGS. 1-3 with the top panel removed showing portions of the mist delivery system described herein including a water supply connection.
Figure 8:
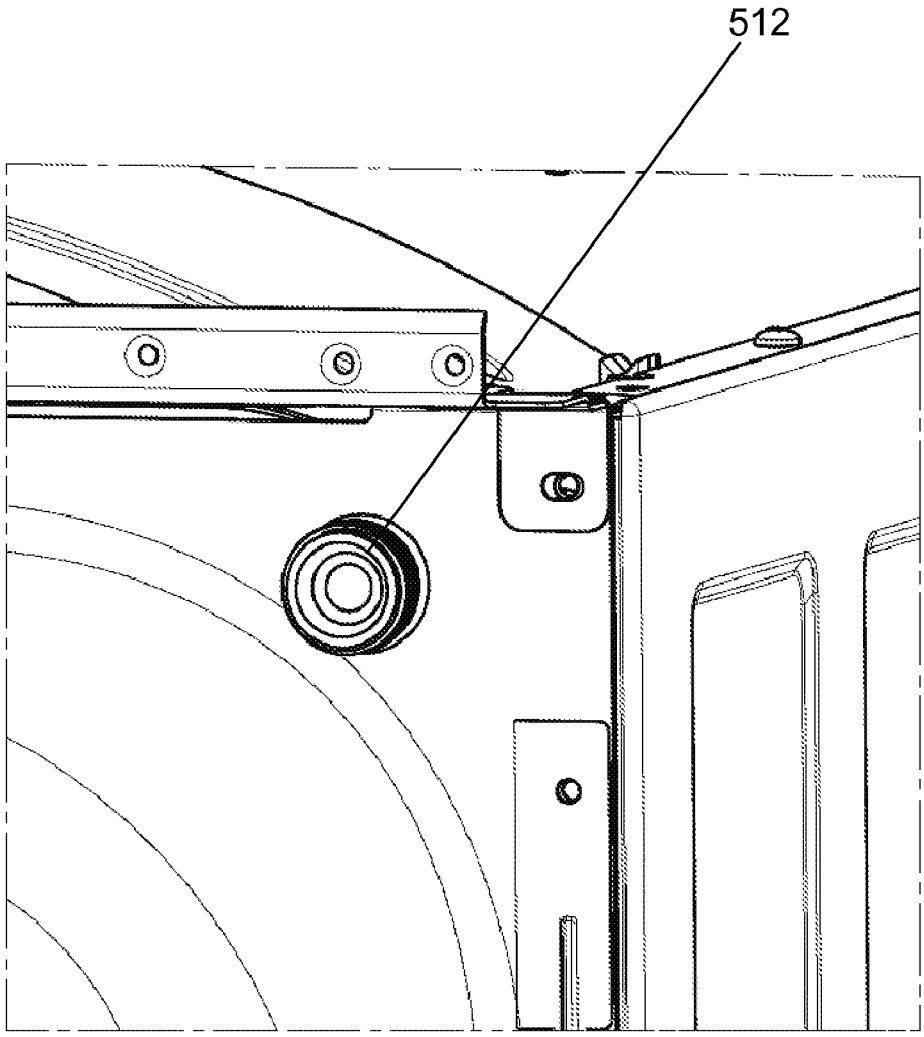
FIG. 8 is a close view of the water supply connection of FIG. 7.

FIG. 6 illustrates the operational differences of blower assembly 118 when operated in direction A (referred to as a forward direction) versus direction B (referred to as a reverse direction) for an example configuration of the blower assembly. Line AA shows example static pressure (inches of water) versus airflow (cubic feet per minute) provided by blower assembly 118 when rotated in direction A and providing Airflow A. Line BB shows the same for when the blower assembly is rotated in opposite direction B and providing Airflow B. As shown, the airflow rate is significantly lower when the blower assembly is operated in direction B than in direction A. Likewise, the pressure of the driven air is significantly lower when it is operated in direction B than in direction A. The blower blade configuration may be selected to provide the desired differential flow characteristics in the two rotation directions.

As illustrated in the chart of FIG. 6, Airflow A can be two or more times greater than Airflow B and is preferably three or more times greater than Airflow B. Even more preferably, Airflow A is about four times as much as Airflow B. Further, Airflow A preferably has a static pressure that is two or more times greater than the static pressure of Airflow B. Such differences in the airflows permit enhanced de-wrinkling benefits and related benefits, such as fabric freshening and odor removal, via the introduction of moisture to the drum while reduced Airflow B is being provided, along with providing effective drying while much greater Airflow A is being provided. Moisture provided during Airflow B can be retained in the drum longer than during Airflow A due to the lower flow rate and pressure, which enhances the amount of exposure to moisture encountered by fabrics within the drum. Maintaining rotation of the drum and, thus, tumbling of the fabrics at the same time, further enhances their exposure to the moisture and the corresponding amount of de-wrinkling.

In the example configuration shown, blower assembly 118 is a reversible centrifugal blower that provides Airflow A to the drum when driven in forward direction A and an Airflow B when driven in reverse direction B. In alternative configurations, other air delivery mechanisms and systems could be used to provide the Airflows A and B, such as other types of blowers or fans. Further, multiple blower or fan units (not shown) could be used, such as a first unit to provide Airflow A and a second unit to provide Airflow B.

Air delivery system 117 is an efficient system that can provide both Airflow A and Airflow B using one single-speed motor to reversibly drive both the drum and the blower assembly. Such an arrangement reduces the number of components and the complexity of controls required to provide the two different airflows during operation, as compared to a dual motor or variable speed motor arrangement, or arrangements of adjustable valves or ducts for actively altering airflow along the flow path. Further, such an arrangement takes advantage of the reverse operation of drum rotation, which is desirable for de-tangling fabrics. In addition, providing reduced Airflow B for only a particular rotation direction of the drum permits advantageous placement of a nozzle 518 (FIG. 10) within the drum to enhance the application of moisture to the rotating fabrics as they are rotating just past the top of their rotation within the drum.

Referring now to FIGS. 7-11, an example moisture delivery system 510 is shown. Moisture delivery system 510 generally includes an inlet connection 512, a control valve 514, a drum conduit 516, and a nozzle 518. The moisture delivery system can receive water from a fresh source via an inlet connection, such as a hose connected to a water supply faucet, which can be in the form of a hose connection 512 at a rear portion of the dryer that is adapted to couple with such a hose.

The water supply could be from either a hot water or a cold water supply faucet. Control valve 514 can be a solenoid valve or other type of selectively controllable valve that can be activated by control system 130 as appropriate during portions of the dryer operations. The control valve opens and closes as instructed by the control system to permit water to flow from inlet connection 512 to nozzle 518 via drum conduit 516, which provides a path from the valve to the nozzle.

Figure 10:
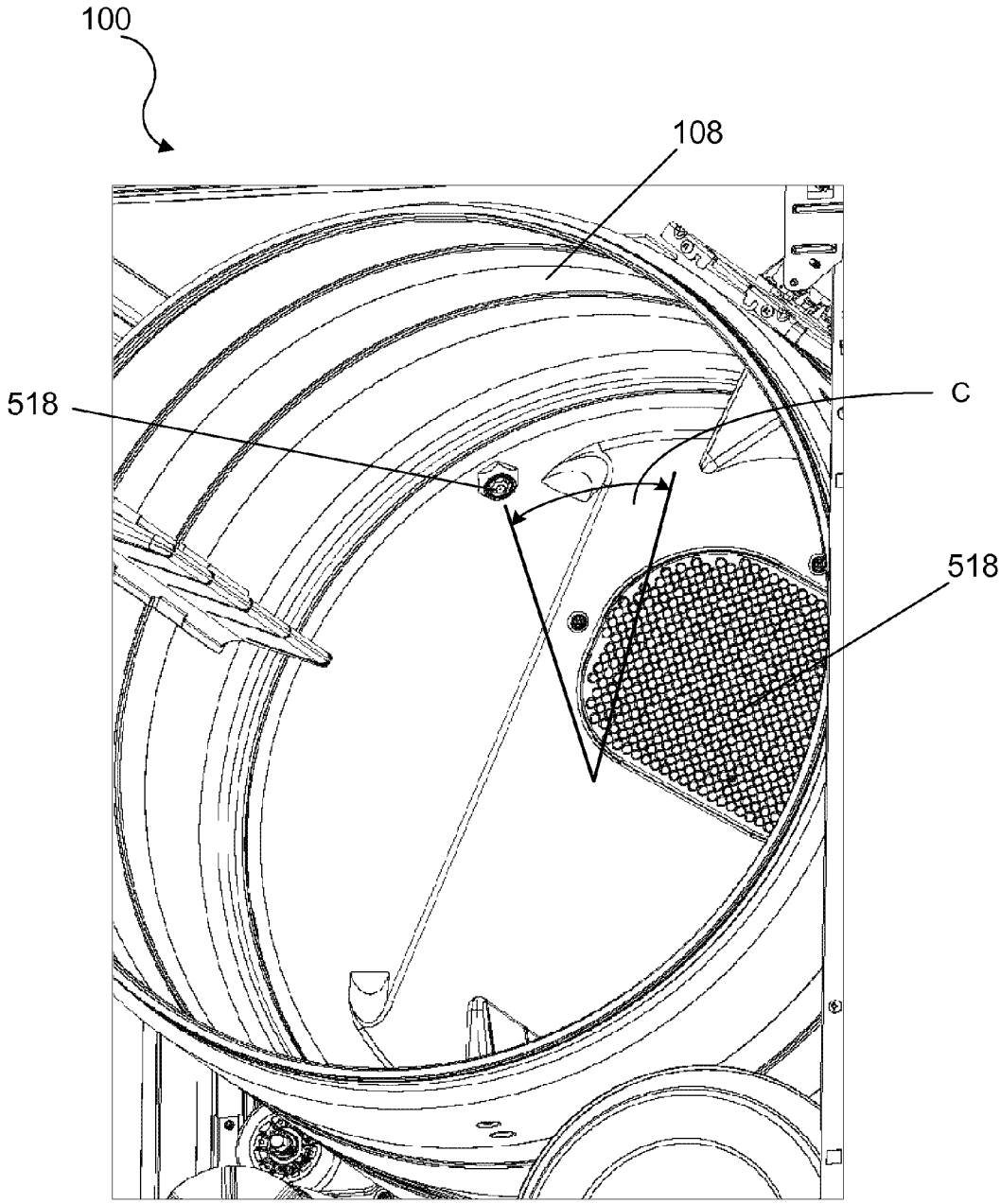
FIG. 10 is a front perspective view of the illustrative dryer showing a nozzle inside the drum.
Figure 11:
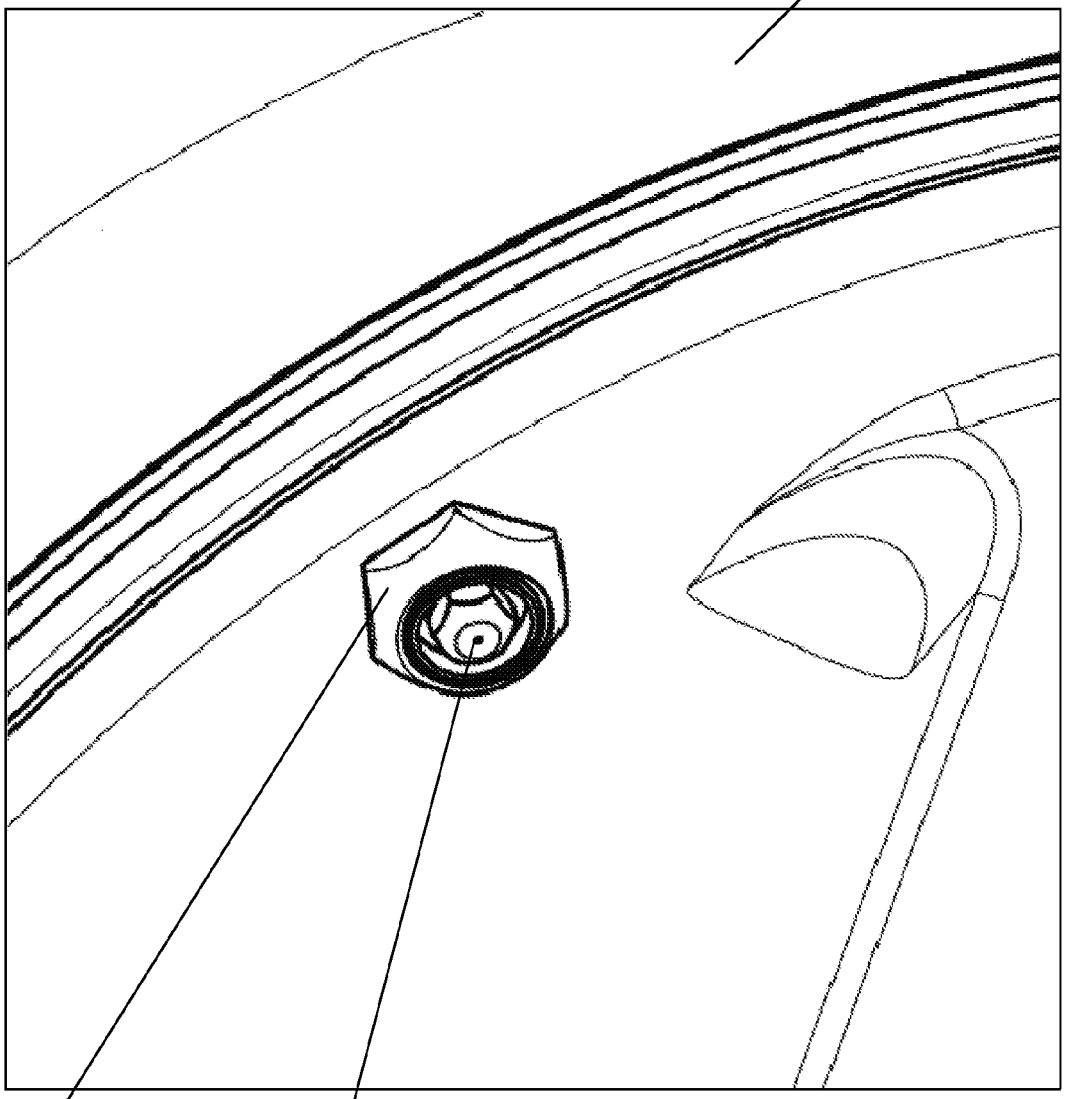
FIG. 11 is a close view of the nozzle of FIG. 10.
Figure 12:
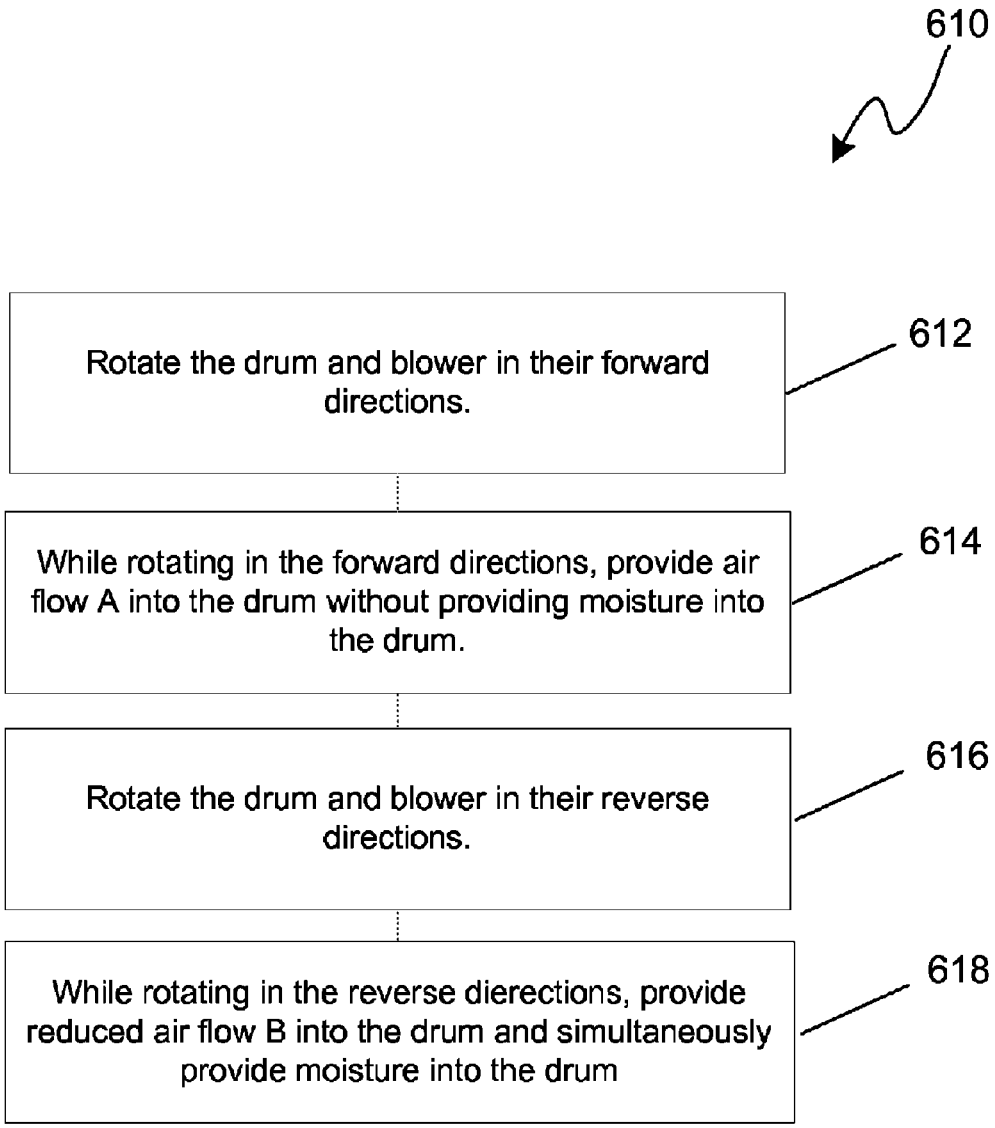
FIG. 12 shows a method for applying moisture to fabrics according to features of the present invention.

As shown in FIGS. 11 and 12, nozzle 518 can be mounted within drum 108 on a fixed rear bulkhead portion of the drum (rear side visible in FIG. 3). In alternative configurations, the nozzle can be disposed within a portion of air path 107, such as within inlet duct 111 shown in FIG. 2. However, placing nozzle 518 directly within drum 108 instead of within the air path provides advantages, such as ensuring all moisture enters the drum and permitting direct application of the moisture to the fabrics. As shown in FIG. 10, nozzle 518 can be disposed at an upper rear portion of the drum proximate air inlet 511, which permits moisture to be sprayed from the nozzle 518 into the flow of air entering the drum via air inlet 511. In such a configuration at the rear of the drum, nozzle 518 is generally opposite exit duct 109 (FIG. 2) disposed at the front portion of the drum through which the air exits. Further, nozzle 518 is located high in the drum versus the location of exit duct 109 low in the drum. This configuration provides a relatively long, tortuous air flow/moisture path through the fabrics before it exits the drum, which encourages exposure of the fabrics to the moisture and its retention within the drum.

In addition, nozzle 518 can be disposed near an upper perimeter of the drum at an angle C (FIG. 10) between 10 to 50 degrees from top dead center of the drum on the downward rotating portion of the drum during its rotation in the reverse direction, which is when reduced Airflow B can be provided into the drum. Fabrics rotating within the drum will likely be dropping at this point in their rotation, which can enhance their exposure to mist being emitted from nozzle 518 and can reduce the possibility of the nozzle being blocked by rotating fabrics.

As shown in FIGS. 10 and 11, nozzle 518 includes a jet hole 520 through which moisture can be sprayed. The moisture can be in the form of droplets provided via a mist, spray or drips, which may (but need not necessarily) turn into steam in the presence of heated air and/or the hot environment within the drum. The moisture can also be provided in gaseous form, such as from a water heating steam generation unit, or in combinations of gas and droplets. The use of hot water from a hot water faucet can enhance the conversion of droplets into steam. However, a water spray or mist from a cool water supply can also be used effectively. Except as otherwise indicated, the term "moisture," as used herein broadly encompasses $H_2O$ in both liquid and gaseous form (i.e., dry steam and/or water in liquid form).

Moisture provided in droplet form, such as a water mist, can provide advantages over the use of steam especially when injected during a cool down cycle. The droplets can act as a heat sink while they warm and evaporate within the drum, which can assist with cooling the hot fabrics while providing de-wrinkling action just prior to their removal from the dryer at the end of the dryer operations. Cool air can be also be provided into the drum simultaneously with the droplets as part of a cool down cycle.

In alternative configurations, steam or a mixture of steam and water droplets can be provided from nozzle 518 via the use of a water heater (not shown) that heats the water prior to its delivery to the nozzle. In other configurations, multiple jet holes or other apertures (not shown) within the nozzle can be used to better disperse moisture in multiple directions. Further, multiple nozzles can be located within the drum. Although jet hole 520 is shown as a generally circular aperture, other apertures can be used, such as fan or blade-shaped apertures and apertures of various sizes, which can provide varying types of droplet sprays for various types of dryers and dryer operations. In further configurations, the water delivery system can include an additive reservoir (not shown), which can mix with water to disperse additives therewith, such as a fabric softener, an anti-static agent, an anti-wrinkle agent or a fragrance. In yet another configuration, the fluid delivery system can include a primary reservoir (not shown) and a pump (not shown) to provide moisture from a fluid stored in the reservoir, such as an anti-wrinkling solution.

FIG. 12 illustrates a method 610 for de-wrinkling/refreshing/deodorizing fabrics according to the moisture delivery features described above. Method 610 can include the step 612 of rotating drum 108 and blower 118 in their forward directions and the step 614 of simultaneously providing Air flow A into the drum without providing moisture into the drum. The method can further include the step 616 of rotating the drum and blower in their reverse directions. In addition, the method can include the step 618 of, while rotating the drum and blower in their reverse directions, providing reduced Air flow B into the drum and simultaneously providing moisture into the drum. Advantageously, the drum rotation speed in the reverse direction may be the same as that in the forward direction, yet the airflow will be significantly reduced. Thus, tumbling action need not be compromised in order to achieve the reduced airflow. In addition, rapid repetitious on-off actuation of the drive motor to achieve a reduced airflow can be avoided, which is beneficial to reduce system wear and stress (e.g., on the motor, motor relays and drive belt) and energy consumption, and for improved de-wrinkling via maintenance of the tumbling action without interruption.

Figure 13:
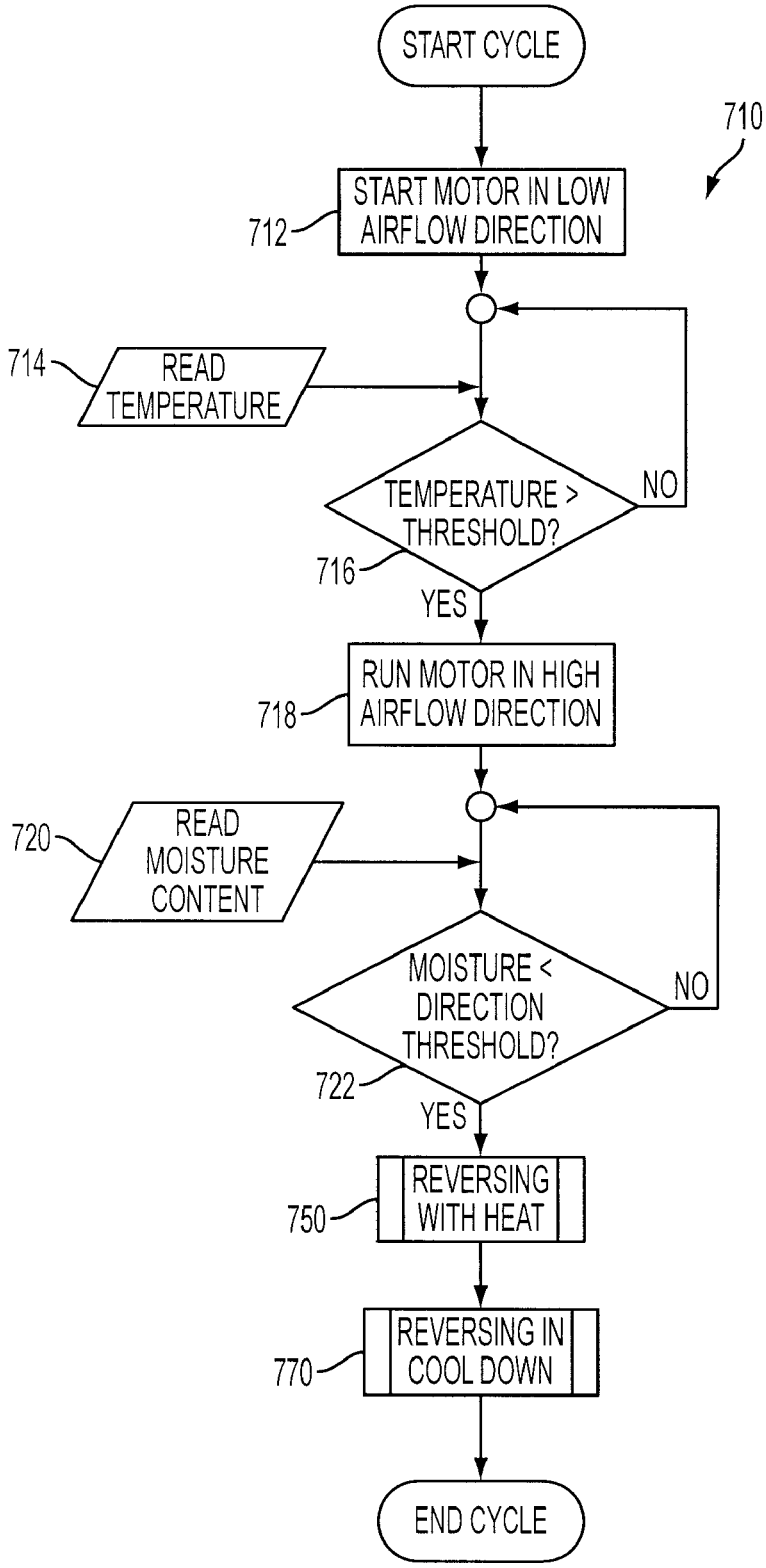
FIG. 13 shows a method for controlling drum reversing and corresponding air flows to provide effective fabric drying while minimizing stresses on the drive system.
Figure 14:
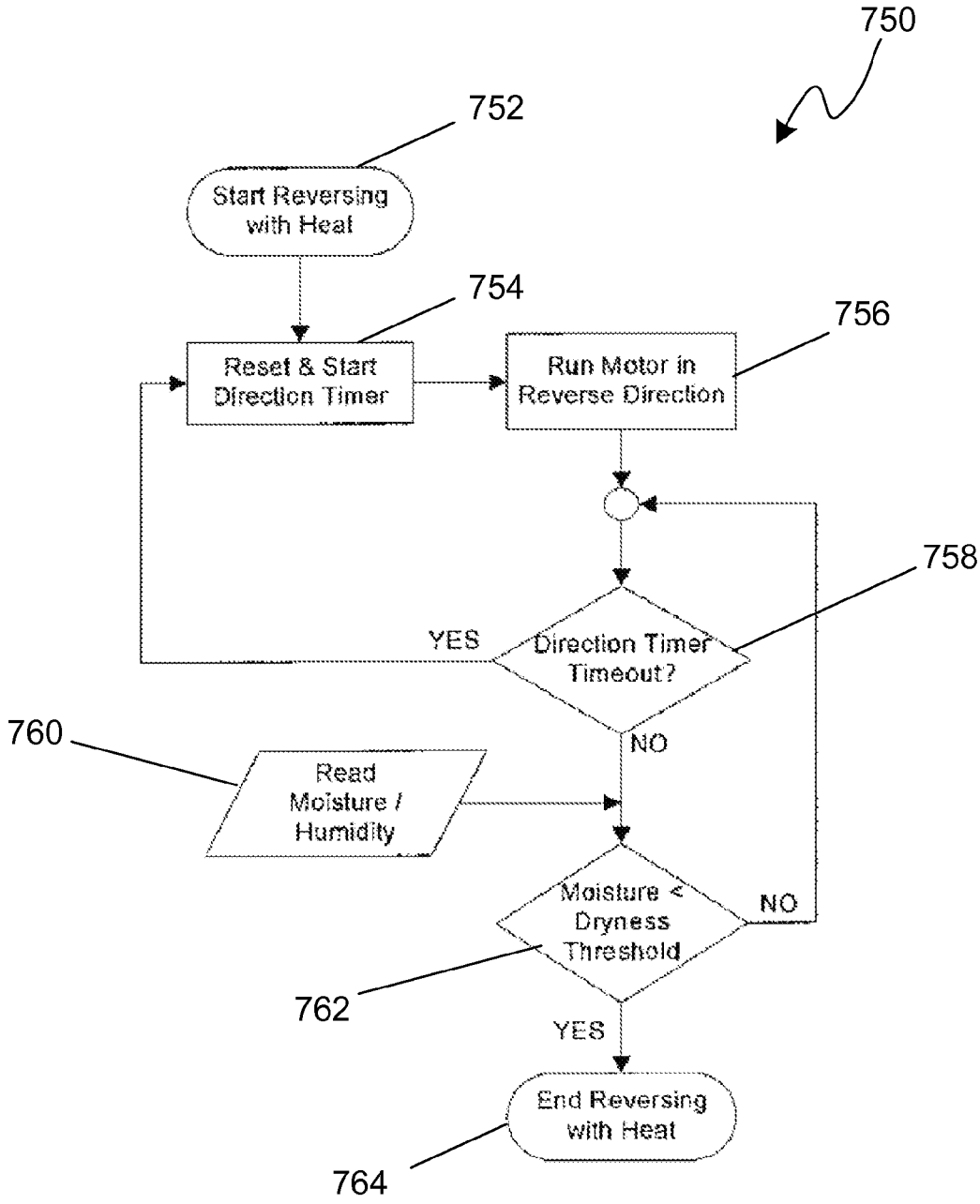
FIG. 14 shows a method for controlling drum reversing and air flows along with heating during a portion of the method of FIG. 13.
Figure 15:
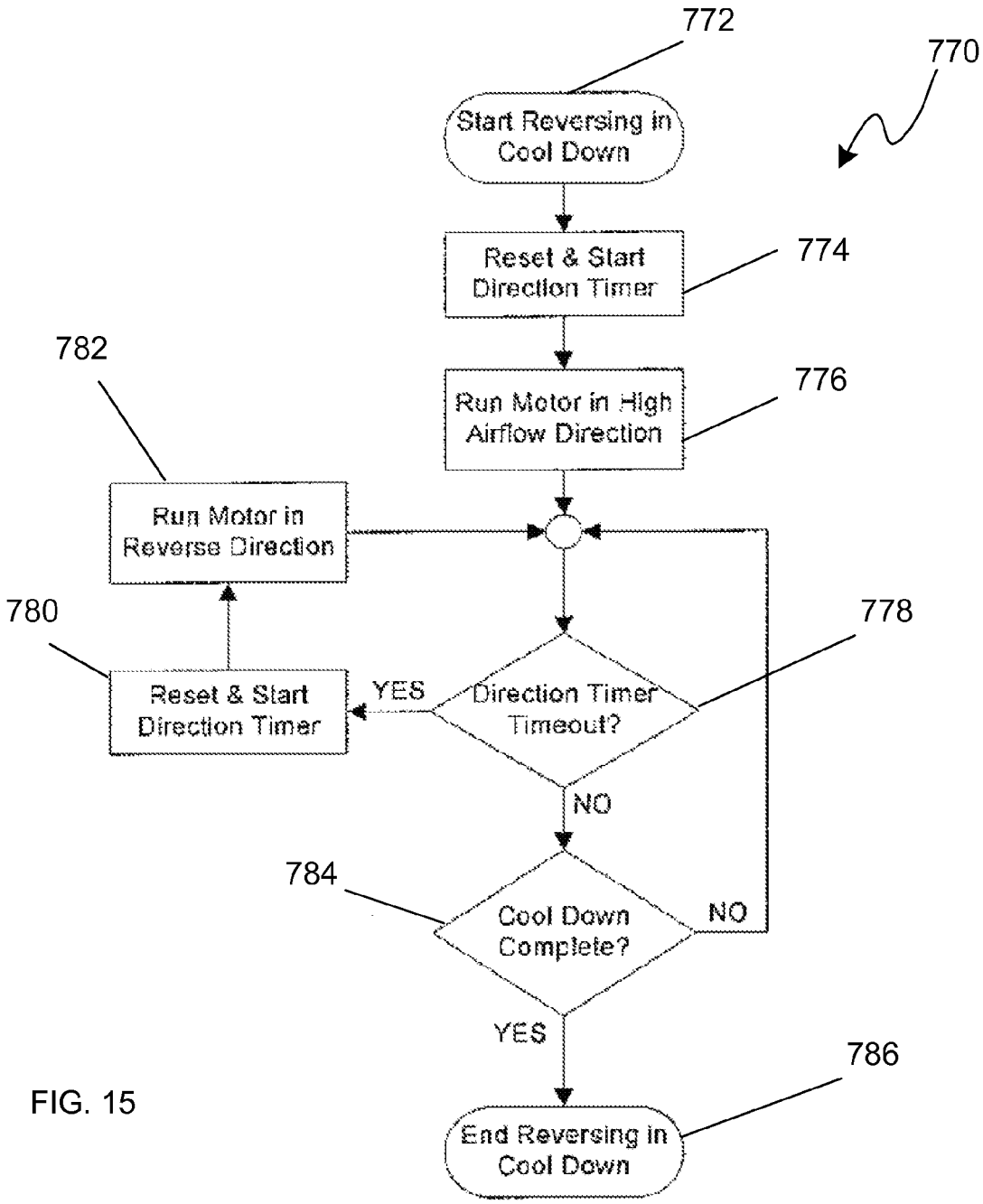
FIG. 15 shows a method for controlling drum reversing and air flows for a cool down cycle during a portion of the method of FIG. 13.

FIGS. 13-15 illustrate a method 710 for controlling a reversing dryer having high and low air flows, such as dryer 100, to provide effective drying while minimizing stresses on the system. The effective drying can be provided via selective control of drum reversals and air flow changes in concert with temperature and/or moisture monitoring. The stress reduction advantages can be provided via selectively reversing the rotation direction of the drum toward the end of dryer operations after sufficient moisture has been removed from the load, at which time the load is lighter and reversals can be more effectively performed with less stress on the drive system.

Method 710 can include the cooperative use of a reversing drum (e.g., drum 108), higher and lower air flows (e.g., air flow A and air flow B) that can correspond to the direction of rotation of the drum, temperature sensors (e.g., sensors 307 (FIG. 2)) to measure inlet and/or exhaust temperatures, and means for detecting the moisture content remaining in the fabrics (e.g., conductive moisture sensor bars 309 (FIG. 3) and associated circuitry. At the start of a drying operation, motor 110*a* can rotate 712 drum 108 and blower 118 in the reverse direction to provide low air flow B to the drum. In an alternative configuration, such as a two motor system, the air flow level can be changed with or without reversing the direction of drum rotation. The initial use of the low air flow direction is designed to improve heat transfer to the drum and the load as it is initially being warmed by keeping low the outflow of warm air.

When the load reaches a desired threshold temperature, during which most of the energy would go into evacuating moisture instead of heating the drum and load, the air flow can be switched to a higher air flow. This can be achieved by reversing the drum rotation direction for a single drive motor configuration, such as dryer 100. Increasing the air flow at this point allows for a faster rate of moisture evacuation. Using example dryer 100 for illustration purposes, control system 130 in cooperation with temperature sensors 307 can read (step 714) the temperature in the drum to monitor when it has warmed sufficiently for high moisture evacuation. Once the desired temperature threshold 716 has been reached, motor 110*a* can be operated 718 in the forward direction to operate blower 118 in the forward direction. Doing so can provide higher air flow A into the drum and accelerate the rate at which moisture is evacuated. Preferably, the drum continues to rotate in the high air flow direction until a desirable threshold amount of moisture has been removed from the load such that it is much lighter and, thus, it would be less stressful on the drive system to implement reversals.

Depending upon the desired settings, rotation of the drum in the same direction (i.e., without reversals) with high air flow A during a period of high moisture evacuation can be performed for a significant portion of the drying process. This portion can continue until the moisture drops below a predetermined threshold level. This predetermined threshold level may, e.g., be when moisture makes up 10-20% of the load (by weight). This can be approximated through detection of the electrical resistance of the load, using moisture sensor 309 (FIG. 3).

Maintaining a single rotation direction until the load reaches a desired moisture level can help keep the motor from overheating by reducing the weight of the load to an appropriate level prior to performing reversals, which can reduce the torque (and associated heat rise) for each starting event. Further, performing a reversing function at this time and additional reversals thereafter can help untangle the load and allow for improved drying for the remainder of the load.

Accordingly, as shown in FIG. 13, control system 130 in cooperation with moisture sensors 309 can continue to read (step 720) the moisture content of the fabrics when it is operating in the high air flow direction until the moisture content drops below the change direction threshold. At this time, the dryer can be controlled to perform step 750 of periodic reversing with heat and step 770 of periodic reversing during cool down. Performing periodic reversing of the drum and alternating air flow levels toward the end of operations can provide the advantages of reversible cycling, such as loosening and de-tangling the load, while reducing stresses and wear on the system by doing so when the load is lighter.

Reversing during steps 750 and 770 can be time and/or temperature based, such as the air flow directions being periodically changed as regulated by load temperature. The periodic reversing of drum direction and air flows (alternating between air flow A and B) can continue through the drying portion of the cycle until the start of the cool down portion. When cool down starts, the drum can be rotated in the high airflow direction to provide air flow A (if it is not already operating in that direction), which can accelerate the cooling process. It can then reverse periodically to provide de-tangling and other advantages related to reversing. Further, as discussed above, moisture can be provided to the load during reduced air flow B portions of drying operations for de-wrinkling and other benefits.

Referring now to FIG. 14, method 750 is shown for controlling reversing of the dryer along with heat after the moisture level drops below the change direction threshold. In step 752, the drum and blower directions are reversed to provide reduced air flow B while heat is being provided. In step 754, a direction timer (not shown) is reset and started. The direction timer can be part of control system 130, such as integrated control logic, or a timing device. As noted for step 758, if the direction timer expires, steps 754 and 756 can be performed to reset the timer and execute a reversal for operation in the opposite direction.

The periodic time intervals may, e.g., be in the range of 2-6 minutes. The interval for the reverse rotation, lower air flow B may differ from the interval for the forward rotation, higher air flow A. For example, the former (B) may be in the range of 1-3 minutes, whereas the latter (A) may be in the range of 2-6 minutes. In one embodiment, the high flow direction interval (A) may be 4 minutes, and the lower flow direction interval (B) may be 2 minutes. An intervening stop interval may be in the range of 1-5 seconds. The setting of the intervals may be guided by balancing the benefits of more frequent reversals against the added stresses placed on the drive system by more frequent reversals, and the potential for motor overheating. Reversals can continue to be performed until readings 760 of the moisture or humidity level reaches 762 a dryness threshold. When the dryness threshold has been reached, the controller ends 764 the reversing with heat portion of the cycle and starts 772 the reversing in cool down portion of the cycle.

As shown in FIG. 15, method 770 for controlling reversing of the dryer during cool down can include resetting (step 774) and starting the direction timer (not shown) for a period specified for directional cycling during cool down. The motor can be run (step 776) in the appropriate direction to provide high Air flow A at the beginning of the cool down period to provide efficient cooling of the load. The opportunity for the greatest temperature reduction of the load occurs when there is the highest differential between the ambient temperature and the higher load temperature. Since this occurs at the start of cool down, it can be useful to utilize the high airflow to provide highly productive cooling initially.

When the direction timer expires (step 778), it can be reset 780 along with performing a reversal 782. Steps 778, 780 and 782 and be repeated for multiple reversals until the cool down portion of the cycle is deemed complete (step 784) by the controller, which ends reversing during cool down at step 786. Although continuing to perform reversals during cool down can slow the cooling process, it can provide de-tangling benefits near completion of drying operations. Further, reversing to provide Air flow B periodically can provide opportunities to apply moisture selectively to the load near the end of dryer operations for further de-wrinkling benefits.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. A laundry dryer comprising:

a dryer drum;

a drive system for rotating the dryer drum;

an air delivery system for selectively providing air into the drum at one of a first airflow and a second airflow, the first airflow having a higher flow rate and static pressure than the second airflow;

a moisture delivery system for selectively providing moisture into the drum; and a control system for selectively rotating the dryer drum, activating the moisture delivery system, and operating the air delivery system;

wherein the moisture delivery system provides moisture into the drum while the air delivery system is providing air into the drum at the second airflow and while the drive system is constantly driving rotation of the drum.

2. The laundry dryer of claim 1, wherein the drive system selectively rotates the drum in one of a first rotational direction and a second opposite rotational direction, and the air delivery system provides air into the drum at the first airflow while the drum rotates in the first rotational direction and at the second airflow while the drum rotates in the second rotational direction.

3. The laundry dryer of claim 2, wherein the air delivery system includes a reversible blower and the drive system includes a motor for selectively rotating the drum in one of the first and second rotational directions while driving the reversible blower in a corresponding one of a first and a second operational direction, the reversible blower providing the first airflow when driven in the first operational direction and the second airflow when driven in the second operational direction.

4. The laundry dryer of claim 3, wherein the motor is a reversible single speed motor.

5. The laundry dryer of claim 4, wherein the drive system further comprises a drive pulley and a belt that extends about the drum and the drive pulley, and a reversing idler assembly configured to maintain tension on the belt during rotation of the drum in the first and second rotational directions.

6. The laundry dryer of claim 3, wherein the motor is a reversible motor.

7. The laundry dryer of claim 3, wherein the blower includes a centrifugal blower comprising:

a rotatable blower wheel; and curved blades arranged around the blower wheel, the curved blades each having a concave surface and an opposite convex surface, the concave surfaces rotating in a forward direction while the blower is driven in the first operational direction and the convex surfaces rotating in a forward direction while the blower is driven in the second operational direction.

8. The laundry dryer of claim 1, wherein the air delivery system includes an air path comprising:

an intake for receiving air outside of the dryer;

an exhaust for delivering air outside of the dryer; and a path from the intake through the drum to the exhaust;

wherein the path is free of any adjustable valve or duct for actively modifying a flow rate or a static pressure of air travelling through the air path.

9. The laundry dryer of claim 1, wherein the moisture delivered by the moisture delivery system includes at least one of steam and mist.

10. The laundry dryer of claim 1, wherein the moisture delivery system includes a nozzle disposed within the drum on a non-rotatable surface of the drum for providing moisture directly into the drum.

11. The laundry dryer of claim 10, wherein the moisture delivery system further comprises:

an inlet connector for coupling with a water supply;

a pathway for delivering water from the inlet connector to the nozzle; and a valve for selectively permitting water to flow from the inlet connector to the nozzle via the pathway.

12. The laundry dryer of claim 11, wherein the valve includes a solenoid valve.

13. The laundry dryer of claim 1, wherein the moisture delivery system is a heaterless system providing water received in the moisture delivery system to the drum without actively heating the water.

14. The laundry dryer of claim 1, wherein the flow rate of the first airflow is at least two times the flow rate of the second airflow.

15. The laundry dryer of claim 14, wherein the flow rate of the first airflow is at least three times the flow rate of the second airflow.

16. The laundry dryer of claim 14, wherein the static pressure of the first airflow is at least two times the static pressure of the second airflow.

17. The laundry dryer of claim 1, wherein the moisture delivery system refrains from providing moisture into the drum while the air delivery system is providing air into the drum at the first airflow.

18. A laundry dryer, comprising:

a housing;

a rotatable drum contained within the housing, wherein the rotatable drum is rotatable in a first rotational direction and an opposite second rotational direction;

a reversible blower driving air at a first flow rate when driven in a first operational direction and at a second flow rate when driven in an opposite second operational direction, the first flow rate being greater than the second flow rate;

a motor operably connected to the rotatable drum to drive the drum selectively in the first and second rotational directions and to correspondingly drive the blower in the first and second operational directions; and a moisture delivery system providing moisture into the drum while the drum rotates in the second rotational direction and the reversible blower is driven in the second operational direction and provides air at the second flow rate.

19. The laundry dryer of claim 18, wherein the water includes at least one of water mist, steam and a mixture of water mist and steam.

20. The laundry dryer of claim 18, wherein the water delivery system is a heaterless system providing water to the drum without actively heating the water.

21. The laundry dryer of claim 18, wherein the first flow rate is at least two times the second flow rate.

22. The laundry dryer of claim 21, wherein the first flow rate is at least three times the second flow rate.

23. The laundry dryer of claim 18, wherein the air driven at the first flow rate has a greater static pressure than air driven at the second flow rate.

24. The laundry dryer of claim 23, wherein the static pressure of air driven at the first flow rate is at least two times the static pressure of air driven at the second flow rate.

25. The laundry dryer of claim 18, wherein the water delivery system includes a nozzle disposed within the drum on a non-rotatable surface of the drum for providing water directly into the drum.

26. The laundry dryer of claim 19, further comprising an air path comprising:

an intake for receiving air outside of the dryer;

an exhaust for delivering air outside of the dryer; and a path from the intake through the drum to the exhaust;

wherein the air path is free of any adjustable valve or duct for actively modifying a flow rate or a static pressure of air travelling through the air path.

27. A method for de-wrinkling fabrics, the method comprising:

rotating a drum configured to contain fabrics in a first rotational direction;

while rotating the drum in the first rotational direction, providing a first flow of heated air into the drum, the first flow having a first flow rate;

rotating the drum in a second rotational direction opposite the first rotational direction;

while rotating the drum in the second rotational direction:

providing a second flow of heated air into the drum, the second flow having a second flow rate that is less than the first flow rate; and dispensing moisture into the drum.

28. The method of claim 27, wherein, for providing the first flow of heated air into the drum, the first flow has a first static pressure, and for providing the second flow of heated air into the drum, the second flow has a second static pressure that is less than the first static pressure.

29. The method of claim 27, wherein, providing the first flow of heated air into the drum includes operating a reversible blower in a first operational direction, and providing the second flow of heated air into the drum includes operating the reversible blower in an opposite second operational direction.

30. The method of claim 27, wherein providing the first flow of heated air into the drum and providing the second flow of heated air into the drum are performed without activating adjustment of any valve or duct along a path of the heated air, and without any adjustment of an operation speed of a blower drive motor.

31. The method of claim 27, wherein the dispensing of moisture into the drum includes spraying a water mist directly into the drum.

32. The method of claim 27, wherein the dispensing of moisture into the drum includes activating a valve to permit water to flow from an external water supply to a nozzle disposed inside the drum.

33. The method of claim 27, wherein said dispensing occurs only while rotating the drum in the second rotational direction and while providing the flow of heated air into the drum at the second flow rate.

* * * * *